United States Patent [19]

Merino

[11] 4,168,592

[45] Sep. 25, 1979

[54] KIT INCLUDING DOLL, FABRIC CLOTHING AND TOOL

[76] Inventor: Dennis H. Merino, 50733 Ridgemoor Way, Granger, Ind. 46530

[21] Appl. No.: 893,840

[22] Filed: Apr. 6, 1978

[51] Int. Cl.[2] ..... A63H 13/00

[52] U.S. Cl. ..... 46/116; 35/56; 46/162

[58] Field of Search ..... 46/115, 116, 151, 157, 46/162; 35/15, 53, 56

[56] References Cited

U.S. PATENT DOCUMENTS

| | | | |
|---|---|---|---|
| 1,119,087 | 12/1914 | McCarrell | 35/56 |
| 1,176,637 | 3/1916 | Anderson | 46/157 |
| 2,965,981 | 12/1960 | Giovetti | 35/56 |
| 3,051,959 | 9/1962 | Baws | 46/116 X |
| 3,240,176 | 3/1966 | Morrison | 35/26 |
| 3,668,805 | 6/1972 | Coleman | 46/151 |
| 3,783,554 | 1/1974 | Shapero | 46/116 |

*Primary Examiner*—F. Barry Shay

*Attorney, Agent, or Firm*—Ross, Ross & Flavin

[57] ABSTRACT

A doll-dressing assembly kit including a full-bodied, three-dimensional doll having slots therein of precise location and configuration, patterns for use as guides in cutting out two dimensional fabric clothing pieces for enwrapment around the doll, and a special tool for inserting portions of the fabric clothing pieces into the slots for dressing the doll.

5 Claims, 9 Drawing Figures

KIT INCLUDING DOLL, FABRIC CLOTHING AND TOOL

PRIOR ART STATEMENT

The following is a listing of the patents, publications or other information which the applicant believes to be the closet prior art of which he is aware:

U.S. Pat. Nos.:
585,092
1,176,637
2,199,049
2,479,052
2,642,697
3,102,360
3,252,243
3,528,079
3,668,805
4,063,402

The patents are believed to be relevant in that they disclose various structures for dressing dolls, usually being two-dimensional paper dolls incorporating slots in the doll for receiving tabs on paper articles of clothing. Others include snap arrangements wherein snaps on the clothing are interengaged with snaps on the doll.

None is believed to disclose the features of Applicant's doll, wherein a full-bodied three-dimensional doll is provided with slots of precise configuration and location for receiving the edges of two-dimensional fabric which are wrapped around the doll and inserted into the slots by means of a special tool.

A primary object of the invention is to provide a complete doll dressing assembly kit including a full-bodied, three-dimensional doll having slots therein of precise configuration and location, patterns for use as guides in cutting out two-dimensional fabric clothing pieces for enwrapment around the doll, and a special tool for inserting portions of the fabric clothing pieces into the slots for dressing the doll.

Figures 1, 2, 3, 4, 5, 6:
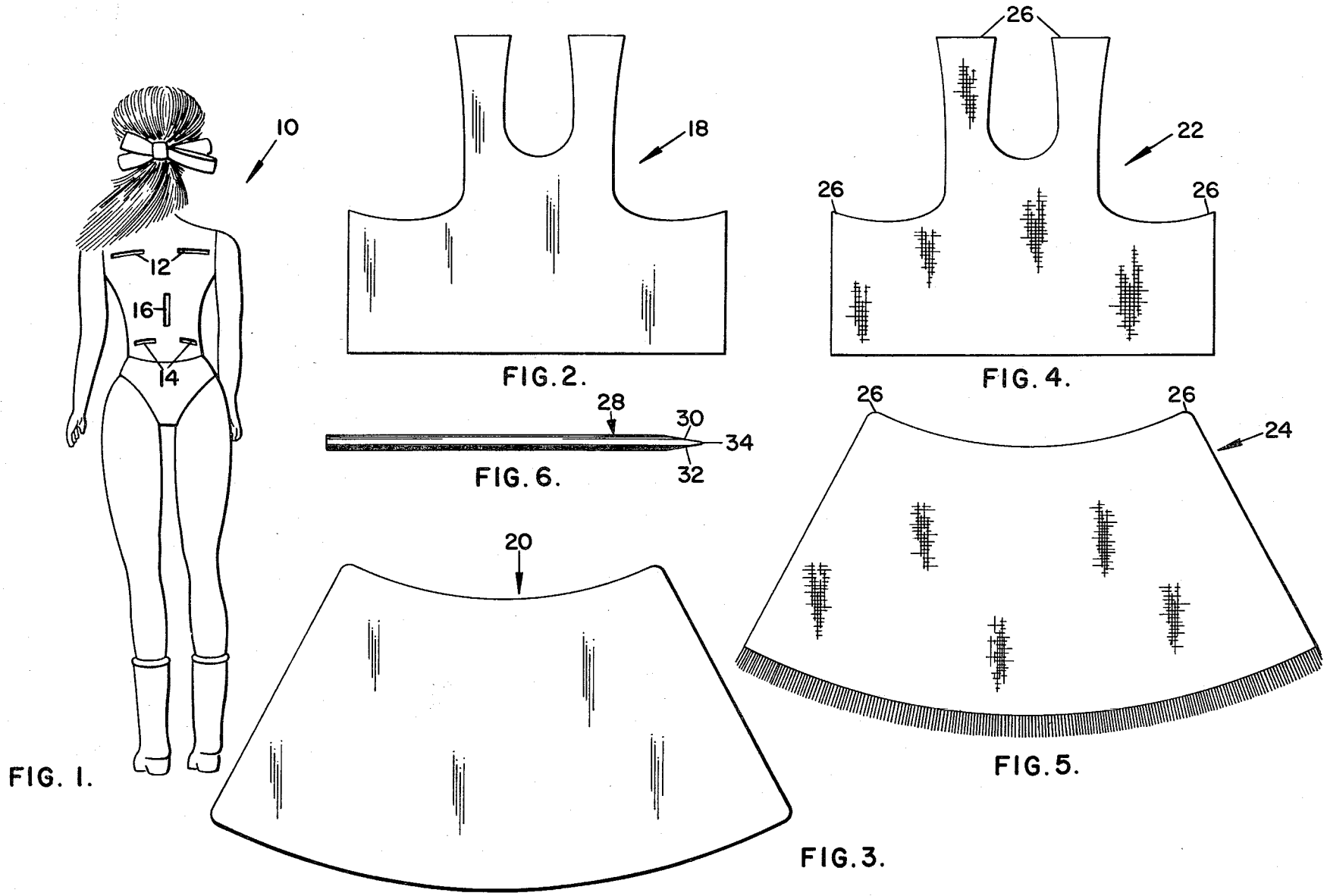
FIG. 1 is a rear perspective view of a full-bodied, three-dimensional doll embodying the invention.
FIGS. 2 and 3 are plan views of patterns for cutting out clothing pieces for dressing the doll of FIG. 1.
FIGS. 4 and 5 are plan views of two-dimensional clothing pieces cut from fabric using the patterns of FIGS. 2 and 3 respectively.
FIG. 6 is a plan view of the special tool for inserting portions of the fabric clothing pieces into the slots of the doll.
Figure 7:
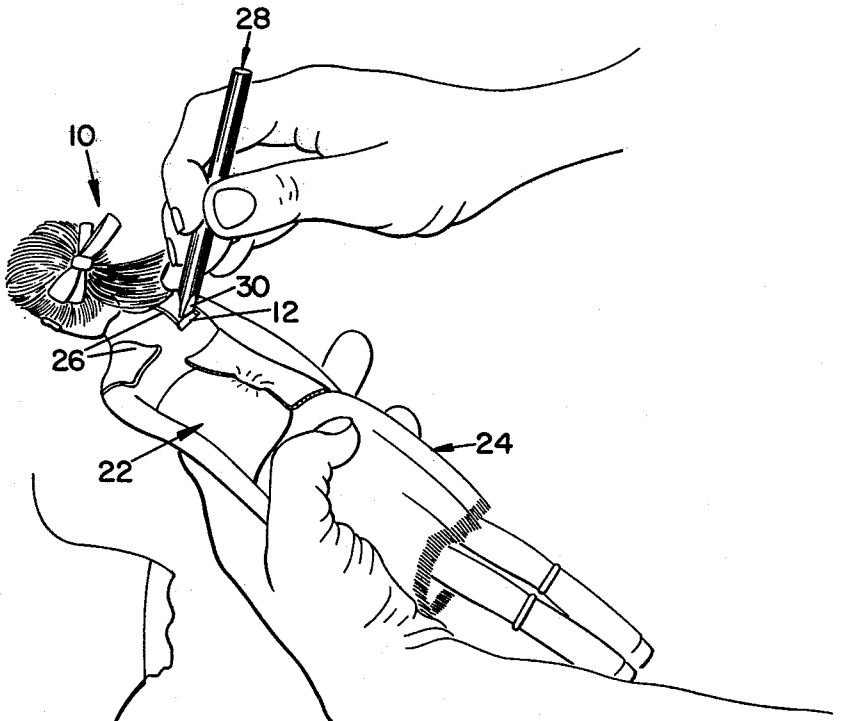
FIGS. 7 and 8 are rear perspective views showing the manner of use of the special tool in dressing the doll with the fabric clothing pieces of FIGS. 4 and 5.

With continued reference to the drawings, FIG. 1 shows a full-bodied, three-dimensional doll 10 embodying the invention, the doll having a plurality of slots cut into the back thereof.

The slots are precisely positioned centrally of the doll back and are of narrow configuration, so as to firmly grip fabric tucked therein, in manner to be described, but are of relatively short length, wherefore the tucks in the fabric are quite unobtrusive.

There are a pair of aligned, spaced, horizontally-extending upper slots 12 disposed adjacent the shoulders of the doll; a pair of aligned, spaced generally horizontally-extending lower slots 14 disposed adjacent the hips of the doll; and a vertically-extending slot 16 disposed centrally of the doll back between the pairs of slots 12 and 14.

Patterns 18 and 20, as seen in FIGS. 2 and 3, preferably of cardboard, are provided for cutting out two-dimensional articles of clothing for the doll, preferably of fabric, such as the blouse or halter 22 of FIG. 4, and the skirt 24 of FIG. 5, respectively.

The articles of clothing are adapted to be wrapped around the doll and are provided with tuck portions 26 adapted for insertion into the slots of the doll, as will appear.

A special tool 28 is provided for inserting the tuck portions 26 of the articles of clothing 22, 24 into the slots 12, 14 and 16 of doll 10.

Tool 28, which is approximately the length of a pencil, is substantially cylindrical and has tapered end faces 30 and 32 at one end thereof which merge to a point 34 in the manner of a screw-driver blade. By such configuration, the tool can be used to insert the relatively bulky articles of fabric clothing into the relatively thin slots in the doll, while permitting easy withdrawal of the tool from the slots.

Figure 9:
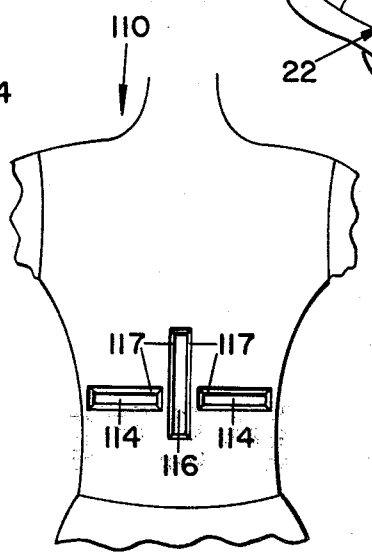
FIG. 9 is an enlarged, fragmentary rear elevational view of a portion of a three-dimensional doll embodying a modified form of the invention.
Figure 8:
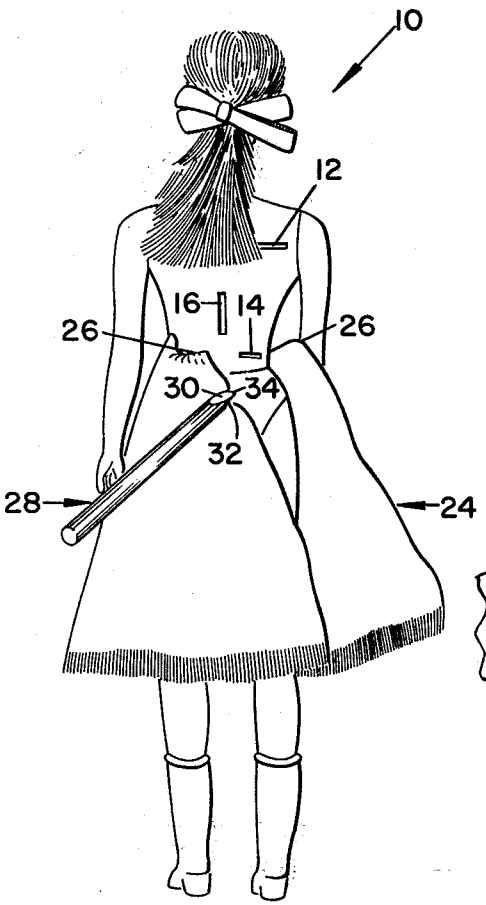

A modified slot arrangement and configuration is shown in FIG. 9. Herein a trio of slots is located approximately centrally of the back of a doll 110, there being a pair of aligned, spaced, generally horizontally-extending slots 114 and a vertically-extending slot 116 disposed centrally between the slots 114.

This arrangement of slots could be further modified by placing them in an inverted T or an upright T arrangement, not shown, centrally of the doll back, if desired.

The edges of the slots are chamferred or bevelled as at 117 to provide a shallow depression over the length of each slot. Such depressions are used, when fabric is laying over the slots, so that the user can identify the slots by running his finger over the fabric, thus telling him where to push the tool.

In both embodiments, the slots ar designed to create a pinching action on the material as it is slipped in so that it will hold the fabric in place. It is important to get this pinch factor to accomplish two things: one to pull the fabric off the tool when the tool is extracted, and secondary, to hold the fabric in place firmly. The location of the slots is important for the reason that when the fabric is cut out, it is designed in such a way that it can be folded around the doll and tucked into the centrally located slots on the rear of the body. This allows the creation of a fully three-dimensional garment as opposed to a two-dimensional garment on a paper doll.

The tucks are designed to be very small so that they are practically invisible on a completed garment. The design of the pattern is unique due to the fact that a two-dimensional piece of fabric is made into a three-dimensional garment. This is normally accomplished with a number of different pieces sewn together in a regular garment, such as the shoulders, back and front, and sleeves. This is accomplished herein by wrapping the material around the doll and tucking it in the centrally located slots in the back of the doll.

The tuck portions of the articles of clothing and the slots in the doll can be numbered or otherwise coded, if desired, to make it easier for the child to dress the doll, simply matching the numbers on each.

I claim:

1. A doll-dressing assembly kit comprising, a full-bodied three-dimensional doll having a plurality of narrow slots in the back portion thereof, two-dimensional fabric clothing pieces adapted to be wrapped around the doll, and a tool for tucking portions of the clothing pieces into the slots of the doll for dressing the doll.

2. A doll-dressing assembly kit according to claim 1, including pattern pieces for use in cutting out the fabric clothing pieces.

3. A doll-dressing assembly kit according to claim 1, wherein the tool has a screw-driver like working end for inserting the fabric clothing pieces into the slots of the doll.

4. A doll-dressing assembly kit according to claim 1, wherein the edges of the slots are chamferred for providing a shallow depression over the length of each slot.

5. A doll-dressing assembly kit according to claim 1, wherein the slots are coded.

* * * * *